United States Patent [19]

Amos

[11] Patent Number: 4,895,087

[45] Date of Patent: Jan. 23, 1990

[54] CONTROLLED STARTING AND STOPPING OF TUFTING MACHINES

[75] Inventor: Kim K. Amos, Dalton, Ga.

[73] Assignee: Spencer Wright Industries, Inc., Dalton, Ga.

[21] Appl. No.: 394,672

[22] Filed: Aug. 16, 1989

[51] Int. Cl.[4] ..... D05C 15/20; D05B 69/10

[52] U.S. Cl. ..... 112/80.18; 112/275; 112/80.4

[58] Field of Search ..... 112/80.18, 80.4, 80.42, 112/274, 275; 318/762

[56] References Cited

U.S. PATENT DOCUMENTS

| | | | |
|---|---|---|---|
| 3,221,683 | 12/1965 | Abelsma | 112/80.18 |
| 3,529,560 | 9/1970 | Jackson | 112/80.18 |
| 3,753,061 | 8/1973 | Owens | 318/762 |
| 3,800,718 | 4/1974 | Johnson | 112/80.4 X |
| 3,967,566 | 7/1976 | Spiegel et al. | 112/275 |
| 4,010,700 | 3/1977 | Webb | 112/80.4 X |
| 4,151,805 | 5/1979 | Long et al. | 112/275 X |
| 4,586,446 | 5/1986 | Cooper | 112/80.4 |
| 4,707,643 | 11/1987 | Rohr et al. | 112/277 X |
| 4,714,039 | 12/1987 | Shimada | 112/275 |
| 4,765,267 | 8/1988 | Nakamura | 112/275 |

*Primary Examiner*—H. Hampton Hunter

*Attorney, Agent, or Firm*—Alan Ruderman

[57] ABSTRACT

A tufting machine having a mainshaft rotatably driven by one or more A.C. motors reciprocably drives a needle bar carrying a multiplicity of needles. Two brakes are associated with the shaft, the first brake being actuated when the motors are deenergized, and the second brake is actuated after the speed of the shaft has been reduced to a predetermined speed which permits the shaft to be stopped with the needle bar and the needles at the top of the reciprocating stroke. The motors may also be gradually started so that attainment of full speed is not reached until after the expiration of a predetermined time interval. Thus, "stop marks" may be substantially eliminated.

15 Claims, 2 Drawing Sheets

CONTROLLED STARTING AND STOPPING OF TUFTING MACHINES

BACKGROUND OF THE INVENTION

This invention relates to tufting machines and more particularly to tufting machines having A.C. motor drives and means for controlling the starting and stopping of the tufting machine mainshaft so that the needle bar may be gradually reciprocated when the machine is started and may be gradually stopped and when stopped positioned at the top of its stroke.

Tufting machines include a rotatable mainshaft which carries a plurality of drive members including those for reciprocably driving a needle bar carrying a plurality of needles and for oscillating the loop seizing members which cooperate with the needles to form stitches. The mainshaft is rotatably driven by one or two electric motors which conventionally may be substantially fixed speed A.C. motors, or variable speed A.C. or D.C. motors. Selection of the type of motor drive is a matter of preference dependent upon a number of factors, and although some of these factors are subjective, cost enters into the selection process. Since A.C. motor drives without variable speed features are somewhat less expensive than the other drives, a substantial number of tufting machines utilize these motors.

A difficulty exists in the tufting process when it is desired to stop the machine, as for example, to thread those needles wherein the thread may have been broken or otherwise unthreaded from the needles. In order to thread the needles, they must be in a raised position above the fabric being tufted, and because threading is most convenient when the needles are at the uppermost portion of the needle bar stroke, it is highly desirable to be able to stop the rotation of the mainshaft when the needle bar is at the top of its stroke. Additionally, and more critical to the appearance of the carpet product being manufactured, particularly loop pile fabric, is that when the machine is stopped rapidly and started rapidly, and especially when stopped at varying locations above the fabric, a distinct line or lines will appear in the fabric which is known in the art as "stop marks." Such "stop marks" are less apparent in cut pile fabric, but in the case of loop pile fabric, it can result in defective product resulting in waste or reduced quality product.

Although "stop marks" are a relatively small problem when the more expensive variable speed A.C. motors or variable speed D.C. motors are used, it remains a difficulty in those situations. When variable speed A.C. motors are used, the motors and thus the mainshaft can be slowed gradually and when the shaft has reached a predetermined speed, a speed sensor actuates a relay to engage a brake to stop rotation of the shaft. The motors and thus the mainshaft can subsequently be restarted gradually. Variable speed D.C. motors are even more expensive than the variable speed A.C. motors, but are less reliable and thus less popular.

The most significant "stop marks" problem results when using the popular constant speed A.C. motors, i.e., induction motors. Tufting machines driven by these motors utilize a single disk brake, air actuated through a solenoid valve receiving an electrical signal when the motor stop button is depressed. However, the motor and thus the mainshaft is rapidly brought to an uncontrolled stop and the needle bar may come to rest randomly at any position. Thereafter, the machine operator uses the "jog" button to position the needle bar at or close to the top of the needle stroke and then may turn a large wheel on the end of the mainshaft to adjust the position of the needle bar at the top of the stroke. When the machine is thereafter started, and the needles form the first stitches, "stop marks" inherently result. One prior art attempt to solve this problem is described in Owens U.S. Pat. No. 3,753,061 wherein a D.C. voltage is applied to the windings the A.C. motors for stopping the motors after the stop button has been depressed. For various reasons, however, this proposal does not appear to have been adapted, and in any event, is not known to now be used.

SUMMARY OF THE INVENTION

Consequently, it is a primary object of the present invention to provide a tufting machine driven by A.C. motor means and incorporating means for substantially reducing "stop marks" from occurring in the fabric being tufted when the machine is stopped and thereafter started.

It is another object of the present invention to provide a tufting machine driven by A.C. motor means and incorporating means for providing gradual starting and stopping characteristics to the tufting machine for positioning the needle bar at the top of its stroke when stopped.

It is a further object of the present invention to provide a tufting machine having a needle bar driven from a mainshaft powered by A.C. motor means, the machine having first and second brake means, the first brake means being activated to slow the mainshaft when power is removed from the motor means, and the second brake means being activated after the mainshaft has slowed to a predetermined speed to stop rotation of the shaft at a predetermined position with the needle bar at the top of its stroke.

Accordingly, the present invention provides a tufting machine having a mainshaft rotatably driven by one or more A.C. motors for reciprocably driving a needle bar, the tufting machine including a first brake operatively connected to the mainshaft and energized upon removal of electrical power to the motors so as to slow the mainshaft, a speed sensing switch for sensing the speed of the mainshaft, a second brake operatively connected to the mainshaft and electrically energized by circuitry including a proximity switch, the proximity switch circuitry being activated by the speed sensing switch when the mainshaft has been slowed to a predetermined speed by the first brake, thereby resulting in the proximity switch sensing a predetermined position of the mainshaft to activate the second brake to stop the rotation of the mainshaft with the needle bar at the top of its stroke.

To accomplish the aforesaid objects, the present invention uses a simple A.C. circuit including the speed sensing switch, the proximity switch, and first and second brakes.

Thus, the present invention provides a solution to a long existing problem merely by incorporating a second brake together with actuating circuitry including a position or proximity sensor activated when the first brake has reduced the speed of the mainshaft to a predetermined low value such that the second brake may stop the mainshaft at a precise angular position corresponding to the uppermost position of the needle bar.

In carrying out the invention simple A.C. circuitry is utilized, as aforesaid, such circuitry being incorporated into the conventional tufting machine A.C. motor circuit together with circuit means for slowly starting the motor(s) when the machine is to be restarted. Thus, the slow or soft stopping provided by actuation of the brakes in seriatim with the second brake actuation occurring at a predetermined low speed together with the physical stopping of the needle bar at the top of its stroke and the slow or soft starting results in substantial reduction of "stop marks" in the product tufted by the machine.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
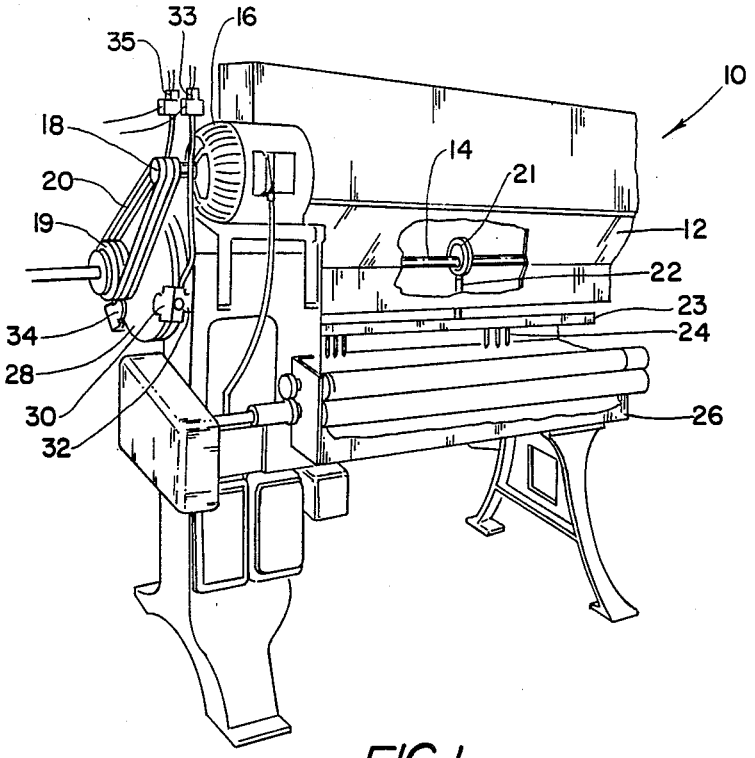
FIG. 1 is a fragmentary perspective view of one end of a tufting machine incorporating apparatus constructed in accordance with the principles of the present invention.
Figure 2:
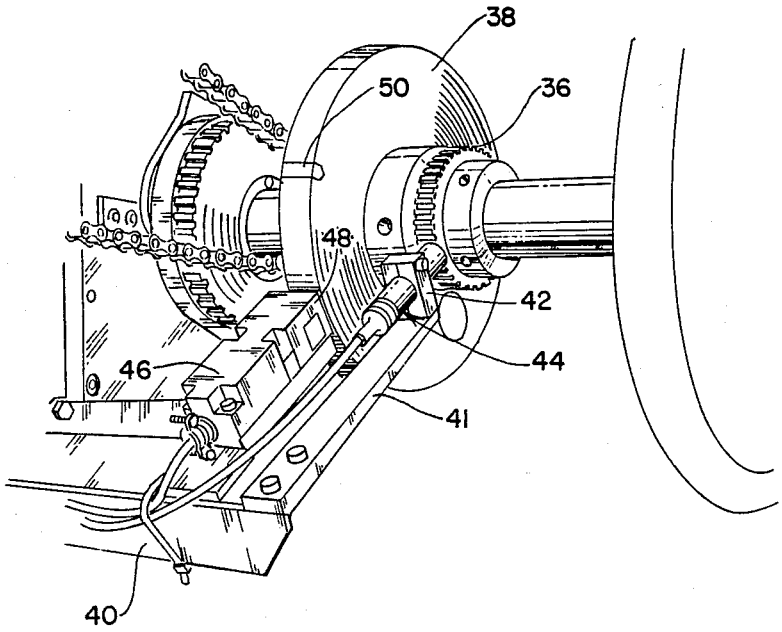
FIG. 2 is a fragmentary perspective view of the machine illustrated in FIG. 1 showing the opposite end of the machine.

Referring now to the accompanying drawings, FIG. 1 illustrates a portion of a tufting machine 10 incorporating apparatus constructed in accordance with the principles of the present invention. The tufting machine includes a head 12 within which a main drive shaft 14 is journally mounted and which extends out at least one end and preferably both ends thereof. The drive shaft 14 is driven by one or more A.C. motors, 16, only one of which is illustrated in FIG. 1, the motor being mounted on the frame of the machine and drivingly connected to an extending portion of the main drive shaft by conventional means such as pulleys 18, 19 and belts 20. Mounted on the main drive shaft 14 within the head 12 of the machine are a plurality of eccentrics 21, only one of which is illustrated, each of which is drivingly connected in conventional manner through push rods 22 to a needle bar 23 which carries a plurality of yarn carrying needles 24 defining at least one needle bank substantially aligned transversely across the machine. Upon rotation of the mainshaft, endwise reciprocation is imparted to the needles for penetrating a backing material B and projecting loops of yarn therethrough.

As is notoriously well known in the art, beneath the head 12 the frame of the machine includes a bed 26 which carries a needle plate (not illustrated) over which the backing material B is fed by feed rollers and beneath which oscillatory hooks or loopers are adapted to cooperate individually with a respective one of the needles 24 to seize the loops formed by the needles in conventional manner and to form pile, the hooks or loopers, feed rollers and all of the other driven elements of the machine being driven by drive means driven from the mainshaft. As known in the art loop or uncut pile, cut pile or both loop and cut pile may be formed. However, "stop marks" are generally more discernible and a greater problem in conjunction with loop pile forming machines.

Conventionally, as aforesaid, the A.C. motor driven tufting machines include a disk brake which is actuated by an air solenoid when the motor or motors are deenergized. Thus, a disk or rotor 28 is mounted on the mainshaft 14 adjacent the pulley 19 and a disk brake caliper 30 is supported by a bracket 32 fastened to the frame of the tufting machine, the caliper conventionally carrying brake pads for grasping the faces of the rotor 28 when the brake is applied. A pneumatic solenoid valve 33 is energized by an electrical signal when the motors are deenergized to rapidly bring the mainshaft and the components driven thereby to a halt. In loop pile machines, possibly because of the inertia of the moving members, or for other reasons, when the motors are again energized and the brake released to drive the mainshaft, the "stop marks" result.

To overcome this problem, the present invention provides a second air actuated brake system comprising a second caliper 34 hereinafter referred to as the "second brake" controlled by a separately energized air solenoid valve 35, the first caliper 30, hereinafter referred to as the "first brake," and the second brake being actuated at distinct times after the motors are deenergized as hereinafter described. Additionally, the first brake may be actuated by lower pressure air than the second brake for reasons which will become clear, the pressure being in the order of 25 psi and 125 psi respectively.

Preferably at the other end of the machine, i.e., the end remote from the rotor 28 and the brakes 30, 34, a multitooth gear 36 and a disk 38 are fastened to the mainshaft so as to rotate therewith. A bracket 40 secured to the adjacent end of the tufting machine frame extends from the frame spaced from the peripheries of the gear 36 and disk 38. The bracket 40 has a portion 41 which carries another bracket 42 which fixedly supports a speed sensing switch 44 with the sensing end closely adjacent the periphery of the teeth of the gear 36, while the housing 46 of a conventional proximity switch 48 is carried by the bracket 40 and extends toward the disk 38 with the sensing end closely adjacent the periphery of the disk 38. The disk 38 may be formed from an aluminum or plastic material, or other nonmagnetic material, having a small steel or other ferrous metal insert 50 secured at a location on the periphery, the proximity switch 48 being adapted to sense the insert as a positioning reference or timing point for the mainshaft when the proximity switch is activated so as to provide an electrical signal when the insert is sensed. The speed sensing switch 44 is a conventional device that senses the rotation of the teeth of the gear 36 and when a predetermined rotational speed is sensed acts to close its contacts and make a circuit.

Figure 3:
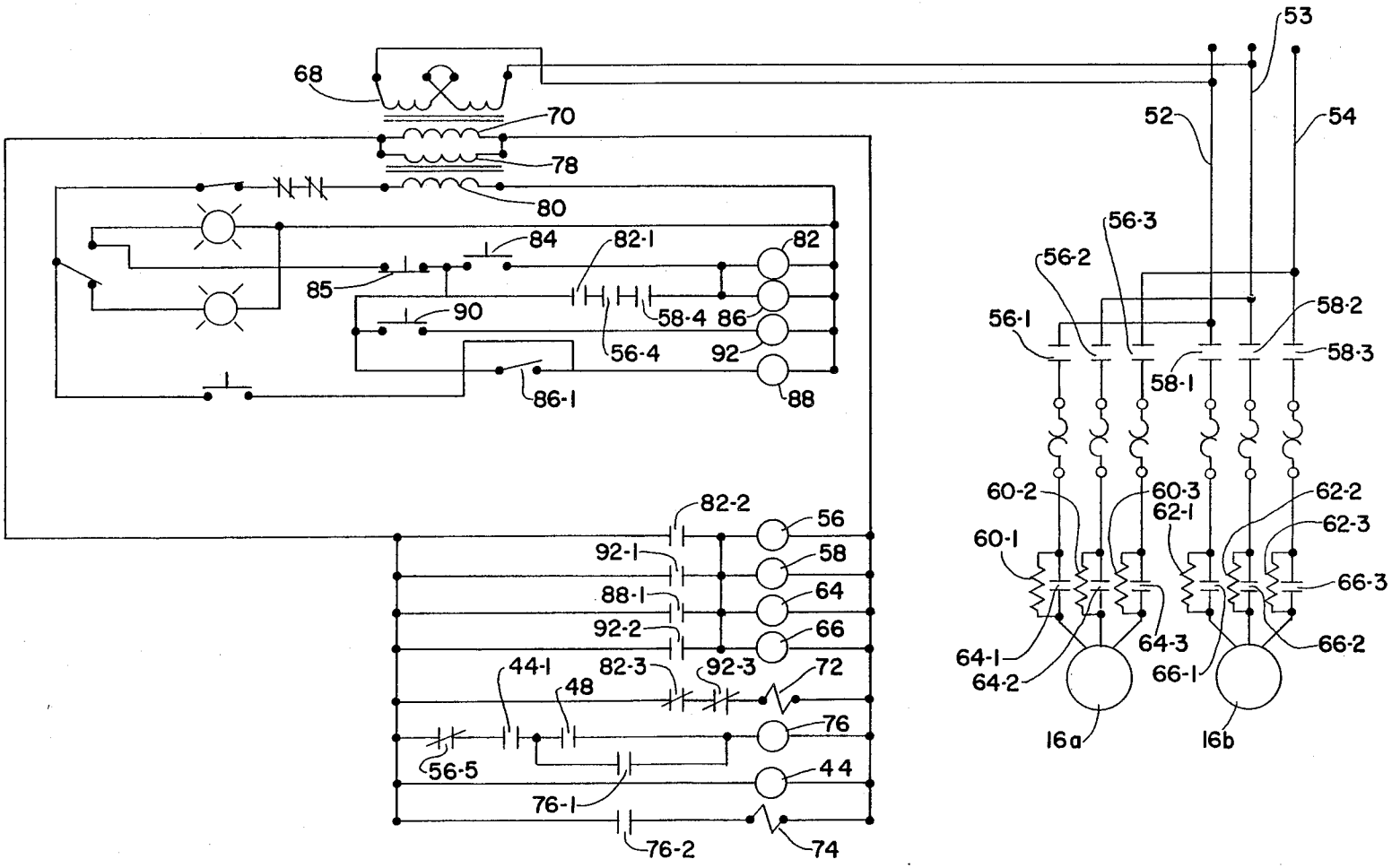
FIG. 3 is a schematic view of the electrical circuitry utilized to control the starting and stopping of the tufting machine.

Referring to FIG. 3, two motors **16*a* and 16*b* are illustrated in the control circuit for driving the mainshaft. The motors are connected in parallel and supplied with 3-phase 440 volt A.C. from a source by leads 52, 53, 54 which are connected to normally open contacts 56-1, 56-2, 56-3 and 58-1, 58-2, 58-3 of the starters 56, 58 associated with the respective motors 16*a*, 16*b*. Each motor is connected in series with a circuit comprising a respective resistance load 60-1, 60-2, 60-3 and 62-1, 62-2, 62-3 which are connected in parallel with respective motor contacts 64-1, 64-2, 64-3 and 66-1, 66-2, 66-3 of respective electro-magnetic contactors, 64, 66. When the coils of the respective motor contactors 64, 66 are energized, the respective contacts 64-1, 64-2, 64-3, and 66-1, 66-2, 66-3**, close to by-pass or short-out the resistance from the motor circuit.

Two of the leads, e.g., 52, 53 are also connected to the primary winding 68 of a transformer to drop the voltage at the secondary winding 70 to 110 or 120 volts which is supplied to a parallel circuit including the coils of the starters 56, 58, the coils of the motor contactors 64, 66, the speed sensing switch 44, the solenoids 72, 74 of the respective air valves 33, 35 associated with the first and second brakes 30, 34, respectively and a control relay 76 for energizing the second brake 34, together with various contact. Additionally, the voltage at the secondary winding 70 is connected to the primary winding 78 of a second transformer and is stepped-down to a low voltage, e.g., 12 volts, at its output winding 80 which is supplied to a parallel circuit which includes a motor activating control relay 82 in series with the start button 84 and the normally closed stop button 85, a timer 86 in series with normally open contacts 56-4 and 58-4 of the starters 56 and 58, and a normally open contact 82-1 of the relay 82, and another control relay 88. Another normally open contact 82-2 of the relay 82 is connected in the higher voltage portion of the circuit in series with the starters 56 and 58 while a normally open contact 88-1 of the relay 88 is connected in series with the coil of the motor contactors 64 and 66.

Thus, when the start button 84 is depressed, the timer 86 and the control relay 82 are energized. The normally open contacts 82-1 and 82-1 close and the normally closed contact 82-3 is opened. The closing of the contact 82-2 energizes the parallel connected starters 56 and 58 to initiate motor starting with the resistance 60-1, 60-2, 60-3 and 62-1, 62-2, 62-3 in series with the respective motor, and the opening of the contact 82-3 deenergizes the first brake solenoid 72 while the second brake solenoid 74 is deenergized by opening of a normally closed starter contact 56-5 to deenergize the relay 76 and thus its normally open contacts 76-1 and 76-2. After a preselected period of time, the timer 86 times out to close its normally open contact 86-1 which energizes the control relay 88. This closes the normally open contact 881 to energize the coils of the motor contactors 64 and 66 to close the contacts 64-1, 64-2, 64-3 and 66-1, 66-2, 66-3 to shunt and thus effectively remove the resistance from the circuits of the motors **16*a* and 16*b*** and permit the motors to attain full speed. Consequently, the motors are started slowly and after a predetermined interval are permitted to reach full speed.

When it is desired to stop the machine, the stop button is depressed which opens the circuit to the motor activating control relay 82 and the timer 86 thereby opening the normally open contacts 82-1 and 82-2 to remove power from the motors **16*a* and 16*b* while closing the normally closed contact 82-3 of the relay 82 and opening the timer contact 86-1. The latter deactivates the control relay 88 to open the contact 88-1 and deactivate the motor contractors 64 and 66 to place the resistance 60-1,60-2, 60-3 and 62-1, 62-2, 62-3 in series with the respective motor. The closing of the normally closed contact 82-3 energizes the solenoid 72 of the valve 33 to port air to and thereby actuate the first brake 30 to slow the mainshaft of the tufting machine. After the speed of the mainshaft decreases to a predetermined speed, e.g., approximately 100 rpm, the contacts of the speed sensing switch 44 close to energize the proximity switch 48. The proximity switch may thereafter sense the location of the insert 50 on the disk, and when it does, its contacts close so as to energize control relay 76 which results in closing of its normally open contact 76-1 This results in the energizing of the solenoid 74 of the valve 35 to port air to and activate the second brake 34** to stop the rotation of the mainshaft with the needle bar disposed at the top of its stroke.

Accordingly, when the stop button is depressed, the machine is gradually slowed until it reaches the preselected speed and is then stopped quickly by.. the second brake 34. This together with the gradual starting of the machine acts to alleviate and substantially reduce the occurrence of the unsightly "stop marks" which have plagued the tufting industry and in particular loop pile fabrics produced by tufting machines having prior art apparatus.

Other elements in the circuitry illustrated in FIG. 3 are for jogging the machine in step-wise fashion and for safety purposes as known in the art. For example, when the jog button or switch 90 is closed it activates a relay 92 to close its contacts 92-1 and 92-2 for starting the motor and when the button is released the contacts open to stop the machine. Other elements are activated to automatically open the circuit when the pressure of the oil fed to the machine is too low and when there is an overload, and to manually stop the machine when something is disposed within the danger zone of the machine.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting machine comprising a frame, a main shaft journally mounted in said frame, A.C. motor means operatively connected to said shaft for rotatably driving said shaft, a needle bar reciprocably mounted in said frame and operably driven by said shaft when said shaft is rotated, a multiplicity of needles carried by said needle bar for cyclically penetrating a base material fed beneath said needle bar first and second brake mean associated with said shaft and actuatable for arresting rotation of said shaft, and electrical circuit means, said circuit means including means for energizing and deenergizing said motor means selectively, means for actuating said first brake means in response to deenergizing of said motor means, and means for actuating said second brake means after said shaft has been slowed to a predetermined speed by said first brake means for stopping rotation of said shaft at a predetermined angular position with said needles disposed substantially at a maximum elevation above the base material.

2. A tufting machine as recited in claim 1, wherein said circuit means includes speed sensing means for sensing the speed of said shaft and for generating an electrical control signal when said shaft has been slowed to said predetermined speed, and switch means responsive to said control signal for providing an electrical signal for actuating said second brake means.

3. A tufting machine as recited in claim 2, wherein said speed sensing means is activated upon deenergizing of said motor means.

4. A tufting machine as recited in claim 1, wherein said circuit means includes resistance means disposed in series with said motor means, and control means for shunting said resistance means a predetermined time interval after energizing of said motor means, whereby said motor means is precluded from attaining full speed until after said time interval.

5. A tufting machine as recited in claim 1, wherein said first and second brake means comprises a rotor mounted on said shaft, and first and second brake calipers adapted to selectively grasp said rotor upon actuation, said first brake caliper being actuated by first solenoid controlled pneumatic valve means and said second brake caliper being actuated by second solenoid controlled pneumatic valve means, said first valve means communicating air to said first brake caliper upon deenergizing of said motor means, and said second valve means communicating air to said second brake caliper after said shaft has been slowed to said predetermined speed.

6. A tufting machine as recited in claim 5, wherein said circuit means includes speed sensing means for sensing the speed of said shaft and for generating an electrical control signal when said shaft has been slowed to said predetermined speed, and switch means responsive to said control signal for providing an electrical signal for actuating said second solenoid controlled pneumatic valve means.

7. A tufting machine as recited in claim 6, wherein said second brake caliper applies a greater grasping force to said rotor than said first brake caliper.

8. A tufting machine as recited in claim 1, wherein said means for actuating said second brake means comprises a multi-tooth gear mounted on said shaft, speed sensing means for sensing the speed of said gear and for generating an electrical control signal when said gear has been slowed to a predetermined speed, a disk mounted on said shaft, said disk comprising substantially non-magnetic material including a magnetic insert secured at a selected angular disposition, on the periphery of said disk, and a magnetic proximity switch fixedly disposed adjacent the periphery of said disk, said proximity switch including means responsive to said control signal for providing an electrical signal for actuating said second brake means.

9. A tufting machine as recited in claim 8, wherein said speed sensing means is activated upon deenergizing of said motor means.

10. A tufting machine as recited in claim 1, wherein said means for energizing and deenergizing said motor means selectively includes a first relay, manually operable start and stop switch means for energizing and deenergizing said first relay respectively, said first relay when energized acting to communicate electricity to said motor means and to terminate communication of electricity to said motor means when deenergized, said circuit means including speed sensing means activated in response to deenergizing of said motor means for sensing the speed of said shaft and for generating an electrical control signal when said shaft has been slowed to said predetermined speed, and switch means responsive to said control signal for providing an electrical signal for actuating said second brake means.

11. A tufting machine as recited in claim 10, wherein said circuit means includes resistance means disposed in series with said motor means, and control means for shunting said resistance means a predetermined time interval after energizing of said motor means, whereby said motor means is precluded from attaining full speed until after said time interval.

12. A tufting machine as recited in claim 10, wherein said first and second brake means comprises a rotor mounted on said shaft, and first and second calipers adapted to selectively grasp said rotor upon actuation, said first caliper being actuated by a first solenoid controlled pneumatic valve means and said second brake caliper being actuated by second solenoid controlled pneumatic valve means, said first valve means communicating air to said first brake caliper upon deenergizing of said first relay, and said second valve means communicating air to said second brake caliper after said shaft has been slowed to said predetermined speed.

13. A tufting machine as recited in claim 12, wherein said circuit means includes a second relay energized after deenergizing of said first relay and after the speed of said shaft has been slowed to said predetermined speed for energizing said second solenoid controlled pneumatic valve means.

14. In a tufting machine having a frame, a mainshaft journally mounted in said frame, A.C. motor means operatively connected to said shaft for rotatably driving said shaft, a needle bar reciprocably mounted in said frame and operatively driven by said shaft when said shaft is rotated, means for feeding a base material beneath said needle bar, a multiplicity of needles carried by said needle bar for cyclically penetrating said base material, and first brake means for arresting rotation of said shaft, the improvement comprising: second brake means associated with said shaft, circuit means for energizing and deenergizing said motor means and for actuating said first and second brake means independently at spaced time intervals, said circuit means including means for actuating said first brake means upon deenergizing of said motor means and for subsequently actuating said second brake means upon reduction of the speed of said shaft to a predetermined speed such that said shaft may be rotatably stopped with said needle bar and said needles raised to a desired disposition above said base material.

15. In a tufting machine as recited in claim 13, wherein said circuit means includes means for delaying for a predetermined time attainment of full speed by said motor means after said motor means has been energized.

* * * * *